US005088127A

United States Patent [19]

Thornock

[11] Patent Number: 5,088,127

[45] Date of Patent: Feb. 18, 1992

[54] POWERED ROTATING DISPLAY IN A HAT

[76] Inventor: Del M. Thornock, 1206 Aspen Dr., Concord, Calif. 94520

[21] Appl. No.: 621,740

[22] Filed: Dec. 3, 1990

[51] Int. Cl.[5] ..... A42B 1/24

[52] U.S. Cl. ..... 2/199; 2/185 R; 40/329; 446/27

[58] Field of Search ..... 40/329, 586; 446/27; 2/196, 199, 195, 10, 175, 184.5, 171, 185 R, 186, 195, 199, 246

[56] References Cited

U.S. PATENT DOCUMENTS

| | | | |
|---|---|---|---|
| D. 155,437 | 10/1949 | Molin et al. | 446/27 |
| 2,907,138 | 10/1959 | Kolwicz | 446/27 |
| 3,881,198 | 5/1975 | Waters | 2/199 |
| 4,488,372 | 12/1984 | Lowen | 446/27 |
| 4,551,857 | 11/1985 | Galvin | 2/7 |
| 4,586,280 | 5/1986 | Dane | 40/329 |
| 4,667,274 | 5/1987 | Daniel | 2/199 |
| 4,680,815 | 7/1987 | Hirsch et al. | 2/199 |
| 4,729,747 | 3/1988 | Yeh | 446/27 |
| 4,777,667 | 10/1988 | Patterson et al. | 2/199 |
| 4,832,647 | 5/1989 | Perlman | 40/329 |
| 4,893,356 | 1/1990 | Waters | 2/199 |
| 4,901,211 | 2/1990 | Shen | 2/199 |

FOREIGN PATENT DOCUMENTS

| | | | |
|---|---|---|---|
| 2535617 | 5/1984 | France | 446/27 |

*Primary Examiner*—Werner H. Schroeder
*Assistant Examiner*—Amy Brooke Varatta

[57] ABSTRACT

A hat having an electric motor driven rotatable display placard affixed to the top exterior of the hat. The driving motor of the placard is powered by a photovoltaic panel attached to the exposed surface of the hat. An electrically conductive circuit connects the photovoltaic panel to the motor. The placard is imprinted with written or graphic advertisements or symbols, and is rotated to attract greater attention.

1 Claim, 2 Drawing Sheets

POWERED ROTATING DISPLAY IN A HAT

BACKGROUND OF THE INVENTION

1. Field of the Invention

This invention relates to improvements in media display, and more particularly to a cap or hat having a powered rotating placard for displaying printed or graphic information. The rotation of the placard includes a DC motor powered by photovoltaic material affixed to the hat.

2. Description of the Prior Art

It is recognized in the advertising industry today, that a moving advertisement will attract much more attention than a stationary advertisement. The ability of a moving advertisement to attract attention as opposed to a stationary display is evidenced by the fact that many communities have outlawed all moving, rotating, or flashing advertisements along their city streets. Moving advertisements are so eye catching that drivers were being distracted from driving, and having accidents while looking at the moving advertisements along the road, a situation which is not seen to be a problem with stationary signs.

Some of the moving displays which have been used in the past have included banners towed by airplanes, rotating billboards, and electrical computerized signs displaying moving figures or printed information. Novelty items have also become a source of product advertisement, and are often merely given away as free promotional items as part of a larger advertising theme. The extent to which some novelty items are successful at promoting the advertising theme is, in part due to the uniqueness of the novelty item on which the add is displayed. This uniqueness is generally the reason the consumer noticed the item in the first place, and then remembered the product on which it was displayed. Therefore a company looking for a novel way to display information would ideally choose one that was unique yet relatively inexpensive, one in which the information was highly noticeable, and one which was acceptable to the public. One way to expose media to the public would be to display a moving placard on a wearable item, such as a hat, which is the invention of this disclosure. Caps, particulary sports oriented caps are extremely popular today, and most already have some form of stationary information thereon.

A past art patent search was conduced to examine novelty hats having moving parts suitable for display of printed advertisements or other information. The following are considered relevant to my invention:

Dane was granted U.S. Pat. No. 4,586,280, on May 6, 1986, for a "Novelty Advertising Cap". Dane's device consists of a baseball-type cap having a miniature transparent mug and spigot adapted to circulate a fluid from the spigot to the mug. The fluid is contained in a closed circulating system to prevent spillage. This device appears to limit the range of products which it is suited to advertise, being more oriented towards advertisement of alcoholic beverages.

On May 19, 1987, Daniel was issued U.S. Pat. No. 4,667,274, for a "Self Illumination Patch Assembly". This device is a cap onto which is mounted a lighted sign. While this device is capable of displaying a wide range of printed advertisements, the display is still stationary. The only movement of the advertisement is provided by the wearer himself.

Patterson was granted U.S. Pat. No. 4,777,667, on Oct. 18, 1988, for a "Flip Bill Cap". Patterson's device is a wearable cap having a flip-up bill on which is displayed various indicia. Although the bill displaying the advertisement does move, the movement is not continuous. The manual or battery power supplying the movement is designed to only move the bill once, to raise or to lower it. A continuously moving bill on a hat would be quite distracting to the wearer, who would therefore probably not wear it for long. Since this type of advertisement display is most effective when worn by a person, the Patterson cap would not be effective as a constantly moving advertisement display.

A U.S. Pat. No. 4,680,815 was issued on July 21, 1987 to G. B. Hirsch for a "Solar Powered Headwear Fan". The Hirsch device includes the use of photovoltaic material affixed to the exterior surface of a hat to power a cooling fan positioned under the bill of the hat. The fan is aimed toward the face of the wearer.

A U.S. Pat. No. 4,551,857 was issued Nov. 12, 1985 to A. A. Galvin for a "Hot Weather Hat". The Galvin device includes the use of photovoltaic material attached to the exterior surface of a hat, with the power from the solar cells being used to operate a Peltier-effect thermoelectric device placed to cool the wearer's head.

SUMMARY OF THE INVENTION

My invention is a hat having a rotating display placard affixed to the top of the cap. The rotation of the placard is powered by a small DC motor within the hat, which in turn is powered by a photovoltaic panel attached to an exterior surface of the hat. The preferred hat structure is in the form of a baseball style cap because of their current popularity, however, just about any style of hat or helmet would be suitable. The cap itself can be manufactured of any suitable material, ranging from semi-rigid plastic similar to those worn by baseball players, or a flexible fabric cap similar to the more conventional billed caps. The placard may be a flat circular plastic disc affixed edgewardly to a vertical shaft on the top surface of the cap. The placard can conceivably be any suitable shape or material which is suitable for displaying printed or graphic information. The size of the placard can also vary.

The photovoltaic material is preferably sized and of an efficiency level to provide sufficient electricity to power the motor which drives the placard under most artificial lighting situations, and when exposed to the sun. This will allow the invention to operate at sporting events held indoors or outdoors.

In utilizing this form of advertisement medium, the promoters will not only be providing a novel, eye-catching moving display for their product or team, but will also be providing a product to greater circulate the advertisement by providing a useful wearable cap which can be worn in public. Since a person's head is the most visible portion of his body when in a crowd such as at a sporting event, the rotating placard would be exceptionally visible. This type of advertising promotional item would be particularly useful when given away at baseball games or other public gatherings. My rotating placard on a hat is more effective than a novelty advertisement item which is stationary, such as a lapel pin, or a pencil holder which sits on the person's desk at home where it receives comparatively little exposure to the public.

Therefore, a primary object of my invention is to provide a novelty advertisement hat having a movable printed display surface.

Another object of my invention is to provide a novelty advertisement hat which can be comfortably worn by a person for extended periods of time.

A further object of my invention is to provide a novelty advertisement hat which is self powered, using photovoltaic material for the electrical power source.

A still further object of the invention is to provide a novelty display device, which provides a useful service to the wearer, namely a protective sun hat.

Other objects and advantages will become apparent by reading the remaining specification while examining the numbered drawings.

DESCRIPTION OF A PREFERRED EMBODIMENT

Figure 1:
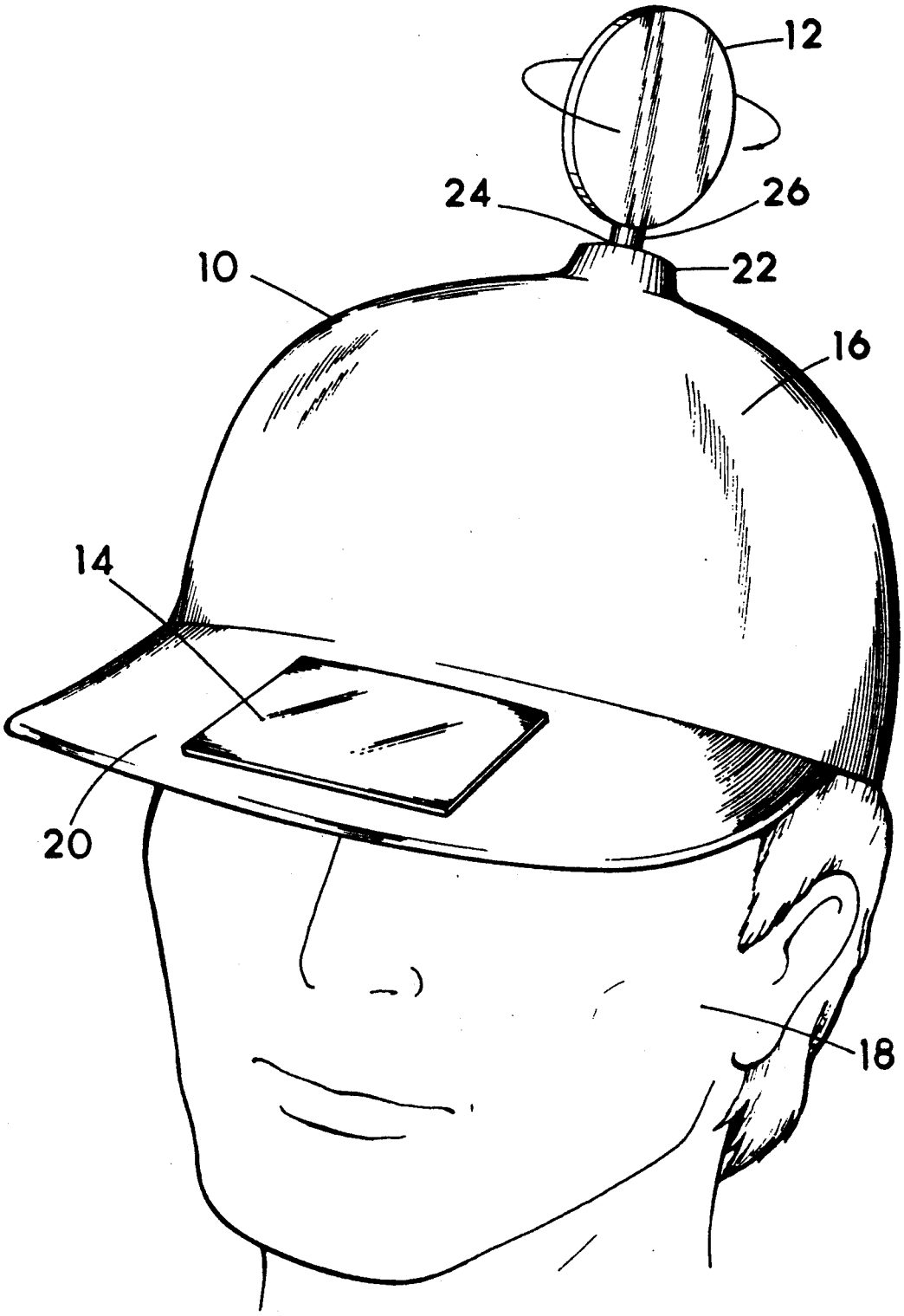
FIG. 1 is a frontal perspective in-use view of my invention illustrating the rotating placard mounted to the top of the cap. The photovoltaic panel is shown affixed to the bill of the cap.
Figure 2:
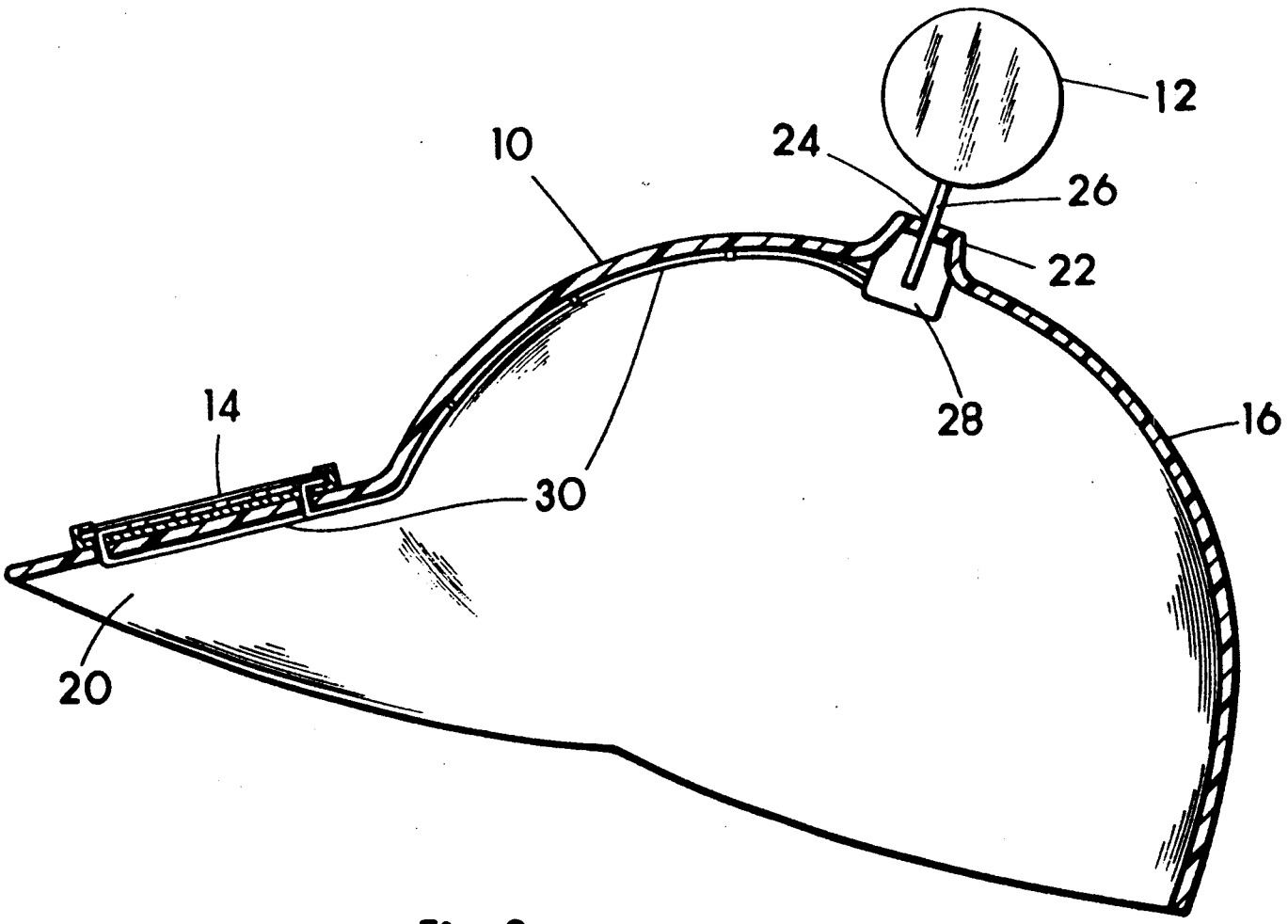
FIG. 2 is a cross-sectional side view of the invention depicting the motor and interior electrical conductors connecting the photovoltaic panel to the motor.

Referring now to the drawings where an embodiment of the invention is illustrated. The invention includes a hat, shown as cap 10 in the drawings, placard 12, a DC motor 28, and an electrical power source shown as photovoltaic panel 14. Cap 10 is comprised of a crown 16, worn on the head 18 of the user, and bill 20, which serves as a sun shade. Cap 10, although shown in the drawings as manufactured of semi-rigid plastic, can be manufactured of flexible fabrics or any other suitable material. Cap 10 is also provided in various size ranges. The top surface of cap 10 may be affixed with a small stiffened annular plate or housing referred to as placard base 22. Placard base 22 contains a central aperture 24 which extends through cap 10, through which is inserted a shaft 26 of motor 28. Placard base 22 may also serve as a mounting base for motor 28 as shown in FIG. 2 where motor 28 is glued to the underside of base 22 and cap 10. Shaft 26 is endwardly connected to motor 28. The opposite end of shaft 26 is affixed to placard 12. As illustrated in the drawings, placard 12 is a flat annular disc affixed vertically, on edge, to shaft 26. Placard 12 is essentially a display surface and can conceivably be any size or shape which is suitable for displaying an advertisement. Even round, square, or irregular shapes may be used, and the advertisement displayed can be graphic in nature, not necessarily printed material. For instance, the figure of a well known bottle shape can be used by itself without written material to advertise a particular soft drink. Placards 12 can also be interchangeable, being removably affixed to shaft 26.

Power is provided in the form of electrical energy to motor 28, generated by photovoltaic panel 14. It is considered within the scope of the invention to affix one or more small batteries to cap 10 as an alternative portable power source to photovoltaic panel 14 for powering motor 28. Photovoltaic panel 14 is affixed to bill 20 of cap 10, but may be attached to any other exterior surface of cap 10 which light would normally strike when the cap was worn. Photovoltaic panel 14 is connected to motor 28 by two insulated electrical conductors 30 connected to form a complete circuit to direct power generated by photovoltaic panel 14 or batteries to operate motor 28. When motor 28 operates, shaft 26 rotates, which in turn rotates placard 12. An optional control switch and electronics may be provided for controlling the speed of the rotating placard 12, and for initiating and terminating rotation. The optional control switch would preferably be located next to photovoltaic panel 14 or placard 12, and in-line with one or both conductors 30.

To provide power to rotate placard 12, the wearer simply positions cap 10 in the sunlight or in artificial lighting, which normally occurs automatically when the cap is worn. Placard 12 will automatically begin to rotate, and will continue to rotate until photovoltaic panel 14 is removed from the light source.

What I claim as my invention:

1. A hat comprising a crown with attached bill and sized for wearing on the head of a person, said hat further including a rotatable advertisement placard sized and shaped for exhibiting advertisement information applied thereon, said advertisement placard affixed to a rotatable shaft, said shaft rotatable by an electric motor affixed to said hat, whereby rotation in said shaft rotates said advertisement placard, a photovoltaic panel attached to an exterior surface of said hat, an electrically conductive circuit between said photovoltaic panel and said motor, said circuit providing means for supplying electrical power produced in said photovoltaic panel to said motor to power rotation in said shaft and thereby rotate said advertisement placard so as to attract increased attention to the exhibited advertisement information on said advertisement placard.

* * * * *